United States Patent [19]

Perr

[11] 4,176,641

[45] Dec. 4, 1979

[54] ANEROID FOR A TURBOCHARGED ENGINE

[75] Inventor: Julius P. Perr, Columbus, Ind.

[73] Assignee: Cummins Engine Company, Inc., Columbus, Ind.

[21] Appl. No.: 755,784

[22] Filed: Dec. 30, 1976

[51] Int. Cl.[2] ..... F02D 1/06; F02D 23/02; F02B 33/00

[52] U.S. Cl. ..... 123/140 FG; 123/140 MP; 60/601; 60/605; 60/611

[58] Field of Search ..... 123/140 MP, 140 FG; 60/600, 601, 602, 603, 605, 611; 137/513.3; 417/279, 295; 137/98

[56] References Cited

U.S. PATENT DOCUMENTS

| | | | |
|---|---|---|---|
| 2,182,933 | 12/1939 | Schimanek | 123/140 MP |
| 2,260,688 | 10/1941 | L'Oräge | 123/140 MP |
| 2,462,796 | 2/1949 | Wheeler | 60/601 |
| 3,330,300 | 7/1967 | Jackson | 123/140 MP |
| 3,757,796 | 9/1973 | Boue et al. | 123/140 MP |
| 3,927,654 | 12/1975 | Perr | 123/140 FG |
| 3,941,035 | 3/1976 | Mueller | 60/611 |
| 3,957,395 | 5/1976 | Ensign | 417/279 |
| 4,005,578 | 2/1977 | McInerney | 60/602 |

FOREIGN PATENT DOCUMENTS

| | | | |
|---|---|---|---|
| 2433862 | 1/1975 | Fed. Rep. of Germany | 123/140 FG |

*Primary Examiner*—Charles J. Myhre
*Assistant Examiner*—P. S. Lall
*Attorney, Agent, or Firm*—Merriam, Marshall & Bicknell

[57] ABSTRACT

This disclosure deals with an aneroid for an internal combustion, compression-ignition engine including a turbocharger. The engine further includes a fuel supply system including a fuel supply rail connected to carry fuel to a plurality of fuel injectors and a regulator for regulating the pressure of the fuel in the supply rail. The quantity of fuel injected in each operating cycle of the engine is a function of the fuel pressure in the supply rail. The aneroid is connected in the rail between the regulator and the injectors, and it includes valve means operative to gradually increase the fuel pressure in the rail downstream of the aneroid, in response to a rise in manifold air pressure. The aneroid further includes means responsive to the downstream fuel pressure for adjusting the valve means to reduce the fuel pressure in response to a rise in the downstream fuel pressure.

20 Claims, 7 Drawing Figures

FIG. 5
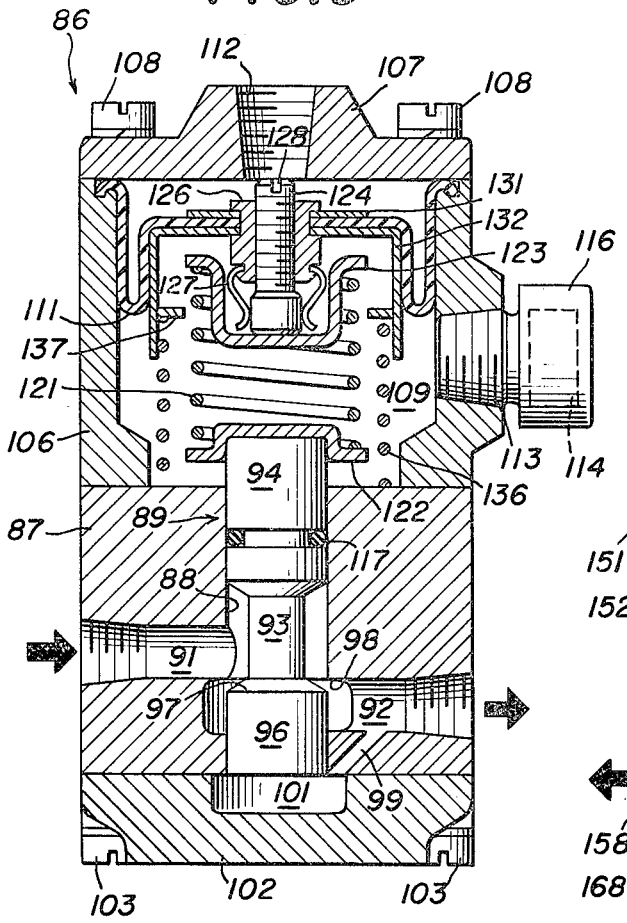
FIG. 6
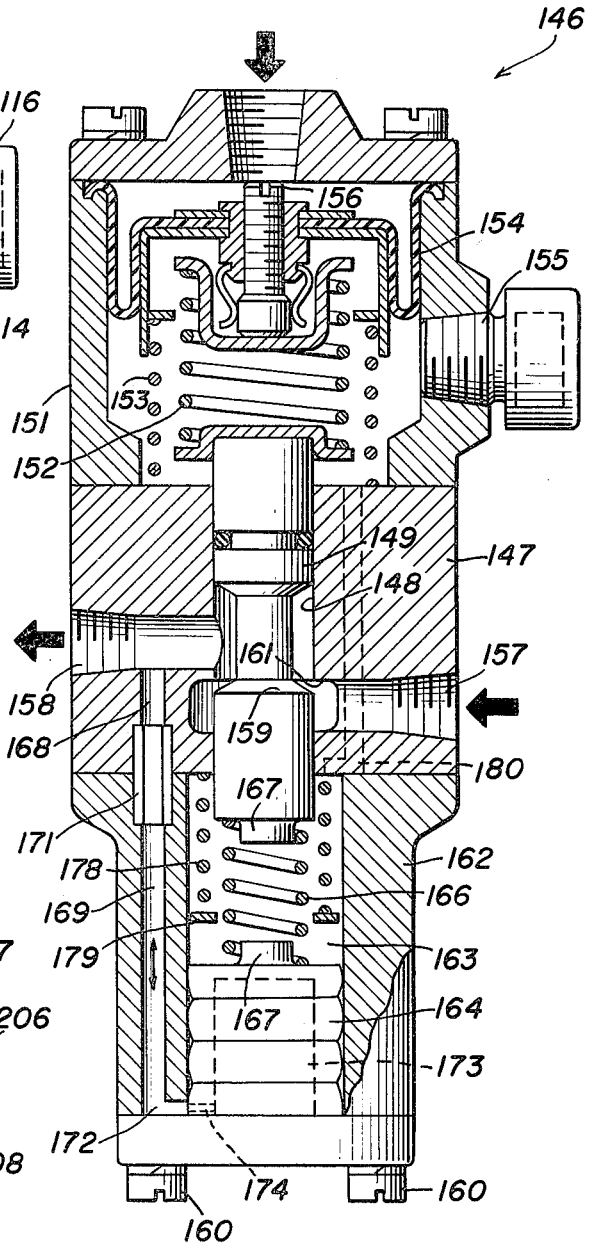
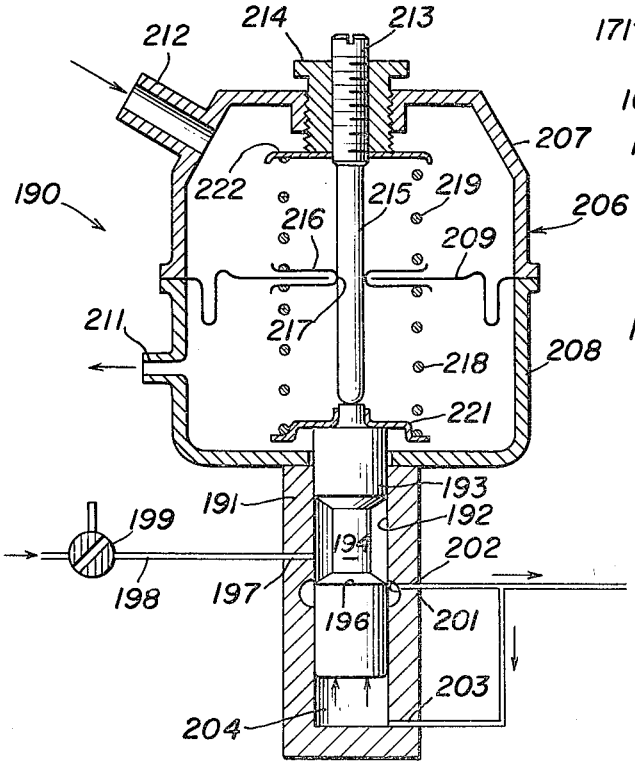
FIG. 7

ANEROID FOR A TURBOCHARGED ENGINE

BACKGROUND OF THE INVENTION

In recent years, it has become increasingly common to provide turbochargers on compression ignition, internal combustion engines. A turbocharger utilizes the hot exhaust gases of the engine as its power source, and it provides a substantial pressure boost in the air intake manifold. A turbocharged engine is thereby able to deliver greater horsepower than a comparable size engine without a turbocharger.

During the operation of such an engine, the ratio of the mass of the fuel to the mass of the air in the cylinders is an important factor. The fuel-to-air ratio affects the power output and the efficiency of the engine, and it has an effect on the amount of pollution produced by the engine. This ratio usually is generally constant over the normal operating speed range of the engine.

A problem encountered in turbocharged engines concerns the maintenance of the desired fuel-to-air ratio. For example, when the throttle is opened to accelerate the engine, the fuel charge is able to increase more rapidly than the air charge. The air charge does not increase as rapidly because the turbocharger cannot quickly respond to the demand for an increase in the supply of air. The result is an over-rich mixture of fuel and air, which is undesirable for a number of reasons.

Some turbocharged engines have been equipped with aneroids in an attempt to eliminate the above problem. Prior art aneroids have been designed to respond to the air intake manifold pressure and to prevent a rapid increase in the quantity of injected fuel during a period of acceleration, until the turbocharger is able to increase its speed and meet the demand for additional air. Such prior art aneroids have not been satisfactory because they have not maintained the desired proportion or ratio between fuel and air, the ratio has not been consistent and predictable, and they have required a start valve for deactivating the aneroid at low engine speeds.

BRIEF SUMMARY OF THE INVENTION

It is therefore a general object of the present invention to provide an improved aneroid for a fuel system, which does not have the foregoing disadvantages.

The present invention comprises an aneroid for a fuel system including a plurality of injectors, a rail for carrying fuel to the injectors, and means for supplying and regulating the pressure of the fuel in the rail. The aneroid comprises valve means connected in the rail and operable to adjust the fuel pressure in the rail, the valve means including a movable member which is movable to adjust the fuel flow area through the rail and thereby adjust the fuel pressure downstream of the aneroid. The aneroid further includes manifold air pressure responsive means connected to the member and operable to move the member in the direction to increase the fuel flow area in response to an increase in the manifold pressure, and rail pressure responsive means connected to the member and operable to decrease the fuel flow area in response to an increase in the fuel pressure in the rail downstream of the aneroid.

BRIEF DESCRIPTION OF THE DRAWINGS

The foregoing and other objects and advantages of the present invention will become apparent from the following detailed description taken in conjunction with the accompanying figures of the drawings, wherein:

FIG. 5 is a sectional view illustrating a preferred embodiment of the aneroid;

FIG. 6 is a sectional view generally similar to FIG. 5 but illustrating another form of the aneroid; and FIG. 7 is a schematic illustration of still another form of the aneroid.

DETAILED DESCRIPTION

Figure 1:
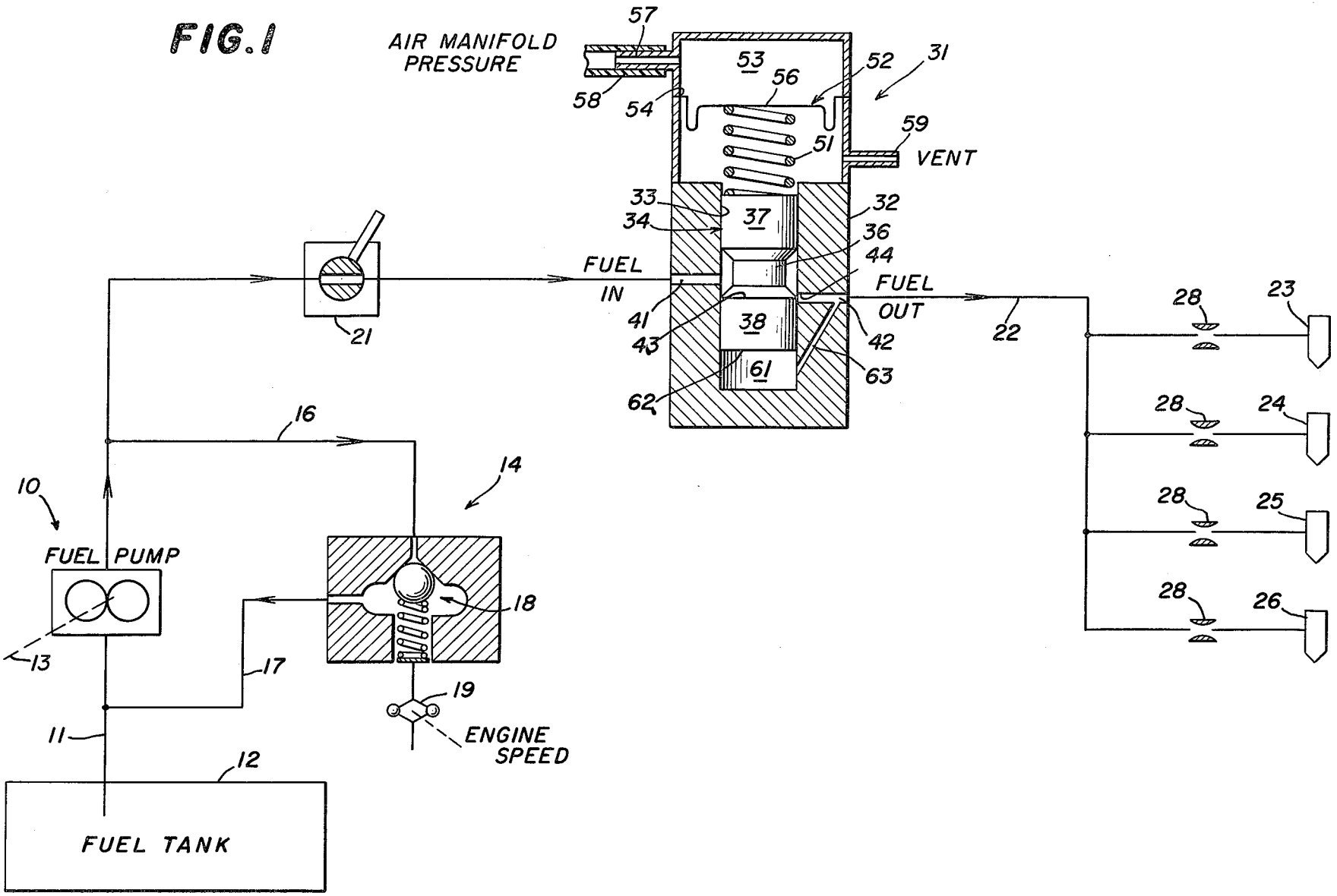
FIG. 1 is a schematic illustration of a fuel supply system for an internal combustion engine, including an aneroid in accordance with the present invention.

The fuel supply system illustrated in FIG. 1 comprises a fuel pump 10 having a fuel intake line 11 connected to draw fuel from a fuel supply tank 12. The fuel pump 10 is normally driven by the engine through a mechanical connection indicated by the reference numeral 13. A pressure regulator 14 is connected to control or regulate the pressure of the fuel in the line downstream of the pump 10. The pressure regulator 14 is illustrated schematically in FIG. 1 and is a bypass type including an intake line 16 and a return line 17. A spring biased ball valve 18 controls the flow of fuel from the intake line 16 to the return line 17, and the force on the ball is regulated in accordance with engine speed by means of an engine driven centrifugal mechanism 19. The pressure regulator 14 and a throttle 21 connected to the output of the pump 10 are preferably of the character described in detail in Reiners U.S. Pat. No. 3,159,152 which is assigned to the assignee of the present invention. Generally, the pressure regulator 14 operates to regulate the fuel pressure at the output of the pump 10 by returning a portion of the fuel through the line 17 to the intake of the pump 10, and the centrifugal mechanism 19 operates to increase the pressure of the fuel in the line leading from the pump 10 to the throttle 21 as the engine speed increases. The operator of the engine may further adjust the pressure of the fuel leading to a fuel supply rail 22 to obtain a desired torque output of the engine.

The engine further includes a plurality of fuel injectors 23 to 26 which are connected to receive fuel from the rail 22. The injectors 23 through 26 may be of the type illustrated and described in detail in the Perr et al U.S. Pat. No. 3,831,846 or the Perr U.S. Pat. No. 3,351,228. In the injectors described in the above two patents, the fuel in the rail 22 is metered into the injectors 23 through 26 through orifices 28. As described in the patents, the quantity of fuel metered into each of the injectors, and the quantity of injected fuel, is a function of the pressure of the fuel in the fuel supply rail 22.

The fuel supply system further includes an aneroid 31 in accordance with the present invention, which is connected in the fuel supply rail 22 between the throttle 21 and the injectors 23 through 26. The aneroid 31 automatically adjusts the fuel pressure in the fuel supply rail 22 in response to changes in the air intake manifold of the engine and in response to the pressure in the rail 22 downstream of the aneroid 31.

The aneroid 31 comprises a housing or body 32 having a bore 33 formed therein. A plunger or valve member 34 is slidably mounted in the bore 33. Both the bore 33 and the valve member 34, in the present example, are generally cylindrical in shape and there is a snug sliding fit between them to prevent leakage of fuel between the adjoining surfaces. The valve member 34 has an annular recess or groove 36 formed therein, thus forming upper and lower enlarged parts 37 and 38. A fuel intake passage 41 is formed through the wall of the body 32 and connects the upstream part of the rail 22 with the bore 33, and a fuel outlet passage 42 connects the bore 33 with the part of the rail which is downstream of the aneroid 31. The fuel intake passage 41 connects with the bore 33 generally centrally of the annular recess 36, while the fuel output passage 42 connects with the bore 33 adjacent the point where the recess 36 joins the lower enlarged part 38. Where the recess joins the part 38, there is formed a circular control edge 43 which, in the position of the parts shown in FIG. 1, partially covers or overlies the fuel outlet passage 42. The upper edge, as seen in FIG. 1, of the port where the passage 42 enters the bore 33, is referred to herein as a control edge 44. It will be apparent from FIG. 1 that if the valve member 34 were moved downwardly, the control edges 43 and 44 would increasingly separate and the fuel flow area between them would increase. The reverse of course is also true. A fuel flow area is thus formed between the control edges 43 and 44, and the size of this fuel flow area is adjustable or varied as the position of the valve member 34 is adjusted. The flow of fuel from the recess 36 to the outlet passage 42 is thereby restricted, resulting in a drop in pressure in the portion of the rail 22 which is downstream of the aneroid 31, and the amount of the pressure drop depends upon the position of the valve member 34 which controls the size of the fuel flow area between the edges 43 and 44.

The valve member 34 is urged in the direction to increase the size of the fuel flow area between the edges 43 and 44, which is also in the direction to reduce the restriction or pressure drop across the aneroid, by a coiled compression spring 51 and a flexible diaphragm 52. The diaphragm 52 is positioned across an enlarged cavity 53 formed in the body 32, and the diaphragm 52 seals the upper part of the cavity 53 from the lower part. The diaphragm 52 is of course fastened and sealed to the body 32 at its edges 54. The compression spring 51 is mounted between the central part 56 of the diaphragm 52 and the upper end surface of the enlarged part 37 of the valve member 34. The upper part of the cavity 53 is connected by a nipple 57 and a tube 58 to respond to the pressure in the air intake manifold of the engine. This is the portion of the manifold which is between the intake passages of the cylinders and the air outlet of the engine turbocharger (not shown). The lower part of the cavity 53, which is the part between the diaphragm 52 and the valve member 34, is vented to atmospheric pressure by a nipple 59.

The bore 33 in the aneroid body 32 also extends downwardly from the lower end of the valve member 34 and forms a fuel receiving chamber 61, and the lower end surface 62 of the enlarged part 38 is exposed to the pressure of the fuel in the chamber 61. Further, a loop passage 63 is formed in the aneroid body 32 and connects the fuel outlet passage 42 with the chamber 61. Consequently, the lower end surface 62 of the valve member 34 is exposed to the pressure of the fuel in the portion of the rail 22 which is downstream of the aneroid 31. It will be apparent that an increase in the fuel pressure downstream of the aneroid 31 will tend to move the valve member 34 upwardly which is in the direction to reduce the flow area between the edges 43 and 44 and thereby reduce the pressure in the rail downstream of the aneroid.

While the engine, the intake manifold, the turbocharger and the connection of the tube 58 with the intake manifold have not been illustrated in the drawings, it should be understood that they are conventional in construction and do not form part of the present invention, and therefore they have not been illustrated and described in more detail.

Figure 2:
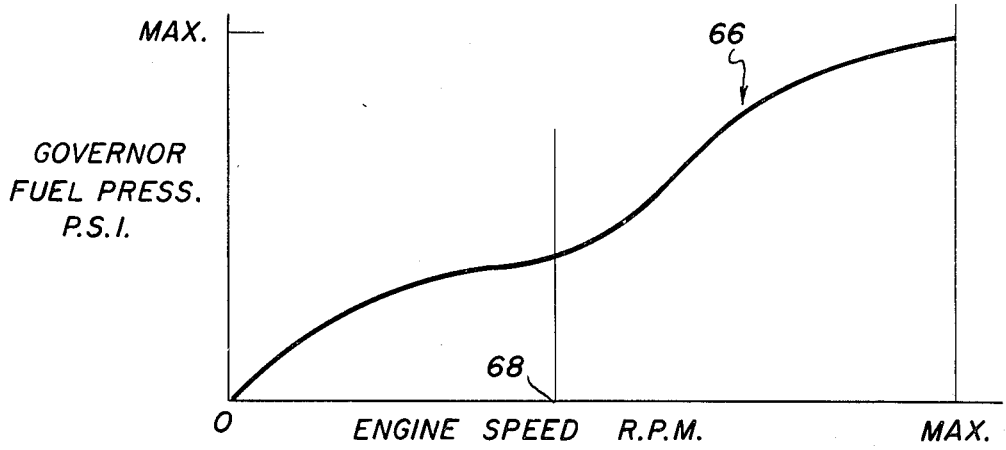
FIGS. 2 through 4 are curves illustrating the operation of the fuel supply system and the engine.
Figure 3:
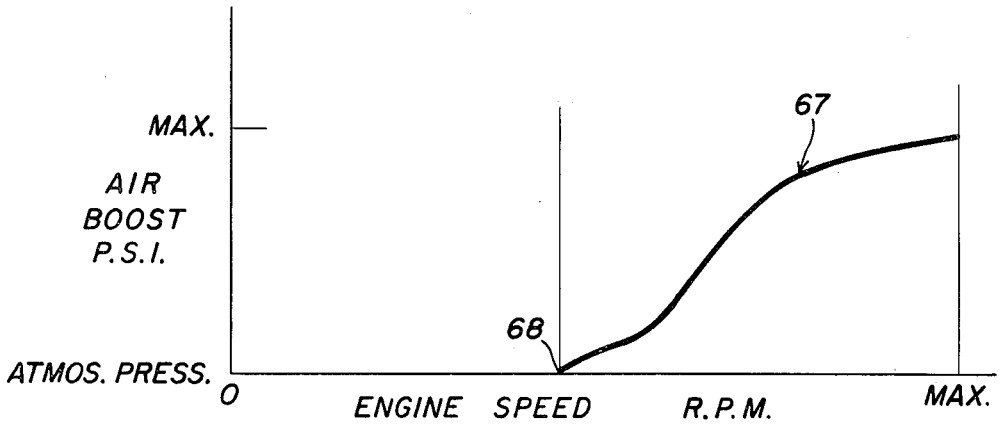
Figure 4:
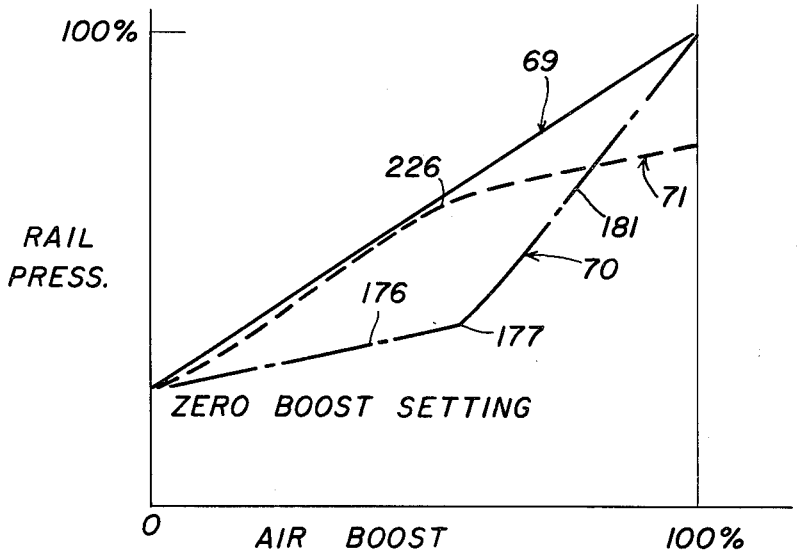

Considering the operation of the fuel supply system shown in FIG. 1 in conjunction with the curves shown in FIGS. 2 to 4, when the engine is running, the fuel pump 10 draws fuel from the supply tank 12 and the pressure regulator 14 regulates the pressure of the fuel as a function of the engine speed. The curve 66 in FIG. 2 illustrates the variation in the pressure of the fuel at the outlet of the pump 10 as a function of engine speed, for the engine speed responsive pressure regulator described in U.S. Pat. No. 3,159,152. The fuel pressure is measured in pounds per square inch and varies from zero pressure up to maximum rated pressure, and the engine speed is measured in revolutions per minute and varies from zero speed up to the maximum rated speed. It will be apparent that the fuel pressure gradually increases as the engine speed increases, and that the fuel pressure drops at the maximum safe engine speed. As previously mentioned, the quantity of fuel injected is a function of the fuel pressure at the orifices 28, and the torque may be varied by varying the fuel pressure. The curve 67 in FIG. 3 represents the air boost in the air intake manifold of the engine, as supplied by the turbocharger, as a function of the engine speed. The air boost varies from atmospheric pressure up to the maximum boost, measured in pounds per square inch, while the engine speed is measured in revolutions per minute. It should be noted that the turbocharger does not provide a positive boost in air pressure until the engine speed reaches the point indicated by the reference numeral 68, which is at the low end of the normal operating speed range of the engine. It should also be noted that the variation in air boost with engine speed generally corresponds to the variation in the fuel pressure with engine speed over the normal operating speed range of the engine. With reference again to FIG. 2, while the curve 66 illustrates the pressure at the outlet of the pump 10 as a function of the engine speed, this does not mean that the curve 66 represents the fuel pressure at the orifices 28. The operator of the vehicle may reduce the pressure below the pressure indicated by the curve 66 using the throttle 21, and the aneroid 31 may also operate to reduce the fuel pressure in the rail 22. FIG. 4 illustrates three curves representing variations in the fuel pressure in the rail 22 downstream of the aneroid, plotted against the air boost, both fuel pressure and air boost varying between 0 and 100%. The three curves are numbered 69, 70 and 71, and are associated with different aneroid constructions disclosed herein.

Fuel leaving the throttle 21 flows through the rail 22 and enters the fuel intake passage 41, flows through the annular recess 36, through the flow area between the edges 43 and 44, and out of the fuel outlet passage 42 to the injectors 23 through 26. Fuel in the outlet passage 42 also enters the loop passage 63 and fills the chamber 61. The pressure of the fuel in the chamber 61 is therefore the same as the pressure in the portion of the rail downstream of the aneroid and the downstream fuel exerts an upwardly directed force on the valve member 34. The amount of this force is of course a function of the pressure of the fuel in the chamber 61, and of the area of the lower end surface 62 of the valve member 34. The fuel pressure in the chamber 61 tends to move the valve member 34 upwardly and thereby reduce the pressure of the fuel downstream of the aneroid by reducing or restricting the size of the flow area between the edges 43 and 44, as previously explained. This upwardly directed force is counterbalanced by the force of the diaphragm 52 which tends to move the valve member 34 in the opposite direction. The amount of the force tending to move the valve member 34 downwardly and increase the fuel pressure in the rail 22 downstream of the aneroid, is a function of the air intake manifold pressure in the upper part of the cavity 53 and of the area of the upper surface of the diaphragm 52.

It should be apparent that any increase in the fuel pressure in the passage 42 due to an increase in the manifold pressure and consequent movement of the valve member 34 downwardly, will automatically tend to move the valve member 34 upwardly and thus reduce the downstream fuel pressure. Consequently, the loop formed by the passage 63 operates to produce a variable force on the lower end of the valve member 34, the force varying with the downstream fuel pressure. The area of the diaphragm 52 is large enough relative to the area of the lower end of the valve member 34, that the valve member will be moved downwardly as the manifold pressure increases and thereby increase the flow area between the edges 43 and 44 and increase the downstream fuel pressure. This characteristic is represented by the curve 69.

Assume that the engine has been operating in a substantially steady state condition in the normal operating speed range of the engine. The air intake manifold pressure is above atmospheric pressure by a factor of, for example, two. The air intake manifold pressure operates on the diaphragm 52 as previously described and the fuel pressure in the passage 42 operates on the lower end of the valve member 32, and the valve member 34 is held in the position illustrated in FIG. 1 where the control edges 43 and 44 are spaced a short distance apart and permit the fuel to flow from the recess 36 to the passage 42. If the operator of the engine quickly adjusts the throttle 21 with the intention of accelerating the engine, the fuel pressure in the portion of the rail 22 which is between the throttle 21 and the aneroid 31 will immediately increase. If it were not for the aneroid 31, this increase in the rail pressure would immediately result in greater quantities of fuel being injected into the engine. Such a rapid increase in the injected fuel quantity would be disadvantageous however without a corresponding increase in the air intake manifold pressure. It is a characteristic of turbochargers that they do not quickly respond to a need for more air, and that they rather slowly increase in speed and air output. The fuel pressure downstream of the aneroid does not, however, immediately increase because the tendency of the pressure of the fuel in the outlet passage 42 to increase results in an increase in the pressure in the chamber 61 and movement upwardly of the valve member 34. The valve member is able to move upwardly because the air pressure on the diaphragm does not immediately increase whereas the fuel pressure on the lower end of the valve member does increase. This upward movement reduces the flow area between the control edges 43 and 44 and reduces the pressure in the portion of the rail 22 downstream of the aneroid. Consequently, the immediate tendency of the fuel pressure in the rail 22 to rapidly increase is countered by the pressure of the fuel in the chamber 61. The downstream fuel pressure does increase slightly however resulting in a gradual speeding up of the engine, and the speed of the turbocharger will also increase and produce a gradual increase in the air manifold pressure and in the pressure in the upper part of the cavity 53. This gradual increase in the air pressure moves the diaphragm 52 downwardly slightly, and the diaphragm 52 will move the valve member 34 downwardly to increase the flow area between the control edges 43 and 44. Consequently, as the turbocharger increases in speed and the boost in the air pressure increases, there will be a gradual increase in the fuel pressure at the fuel outlet passage 42. The fuel pressure and the manifold air pressure will increase as indicated by the line 69 in FIG. 4, thereby producing the desired fuel to air ratio in the engine.

Upon a reduction in the fuel pressure in the rail 22 leading to the aneroid, due to the operator adjusting the throttle 21, the reverse of the foregoing series of events will take place.

FIG. 5 illustrates an aneroid 86 which is generally similar to the aneroid 31 but which includes an adjustment feature and an auxiliary spring for setting the slope of the curve 69 and for stabilizing the operation of the aneroid. The aneroid 86 comprises an aneroid body 87 having a bore 88 formed therein. A valve member 89 is movably mounted in the bore 88, and inlet and outlet passages 91 and 92 are formed in the body 87. The valve member 89 has a recessed portion 93 formed thereon, which forms upper and lower enlarged parts 94 and 96. At the juncture of the recess 93 with the lower enlarged part 96 is formed a control edge 97, and the upper surface of the outlet passage 92, where it enters the bore 88, forms a control edge 98. A return loop passage 99 connects the outlet passage 92 with a chamber 101, and the lower end of the valve member 89 is exposed to the pressure of the fuel in the chamber 101. The chamber 101 is formed in a lower cap member 102 which is secured to the lower end of the body 87 by screws 103.

The valve body 87 has secured to the upper side thereof a chamber forming part 106 and an upper cap member 107, these parts being secured to the body 87 by screws 108. The part 106 forms a chamber 109 that is separated into upper and lower chamber portions by a flexible diaphragm 111. The outer periphery of the diaphragm 111 is secured to the part 106 by being clamped between the adjoining surfaces of the part 106 and the upper cap member 107. A threaded passage 112 is formed centrally in the upper cap 107 which is adapted to receive a coupling for connecting the upper chamber portion with the intake manifold of the engine, so that the upper side of the diaphragm 111 will be at the pressure existing in the engine intake manifold. The lower chamber portion is vented to atmosphere by a coupling 113 which is threaded into a hole formed in the wall of the part 106. The coupling 113 preferably includes a filter element 114 that is held in place by a perforated cap 116, which prevents contaminants from entering the lower chamber portion. Fuel is prevented from entering the chamber 109 by an O-ring seal formed by an O-ring 117 positioned in a groove formed in the upper enlarged part 94 of the valve member 89.

The diaphragm 111 is connected to the upper end of the valve member 89 by a coiled adjusting spring 121 which is mounted between a lower spring retainer 122 and an upper spring retainer 123. The lower spring retainer 122 is seated on the upper end of the valve member 89, and the upper spring retainer 123 is held in engagement with the head of an adjusting screw 124.

The threaded shank of the screw 124 is received in a threaded nut 126, and a spring member 127 connected between the nut 126 and the head of the adjusting adjusting screw 124 holds the screw 124 in an adjusted position. The upper end of the shank of the screw 124 is slotted as indicated at 128 and it is located immediately below the passage 112 in the cap member 107. The adjusting screw 124 may therefore be turned by inserting a screwdriver through the passage 112 and engaging the slot 128 so that the screw 124 may be axially moved to a desired position.

The nut 126 is attached to the center area of the diaphragm 111 by a washer 131 and an inverted cup member 132. The washer 131 is on the upper side of the diaphragm 111 and the cup member 132 fits on the lower side and is coaxial with the adjusting screw 124, the spring retainer 123 and the spring 121. The nut 126 is positioned in centrally located holes formed in the washer 131, the diaphragm 111 and the cup member 132, and the connection between the diaphragm 111 and the nut 126 is sealed.

In addition, an auxiliary spring 136 is positioned around the spring 121 and between the upper surface of the valve body 87 and an annular ledge 137 which is secured to the inner periphery of the cup member 132. It will be apparent that the auxiliary spring 136 tends to move the cup member 132 and the diaphragm 111 upwardly relative to the valve body 87, and that the adjusting spring 121 tends to move the valve member 89 downwardly relative to the cup member 132 and the diaphragm 111.

Assuming that the engine in which the aneroid 86 is mounted has been started, fuel flows into the intake passage 91, through the bore 88 around the recess 93, between the control edges 97 and 98, and out of the valve body 87 through the outlet passage 92. Fuel in the outlet passage 92 fills the passage 99 and the lower chamber 101, and the fuel pressure exerts a force on the valve member 89 tending to push the valve member upwardly. The amount of this force will be a function of the pressure of the fuel in the outlet passage 92 and of the area of the lower end of the valve member 89. This upwardly directed force on the valve member 89 is counteracted by the force of the intake air acting on the diaphragm 111 during cruising speeds of the engine, but at low engine speed there will not be a pressure boost in the intake manifold. Below the engine speed level 68, the diaphragm 111 will be moved upwardly by the fuel pressure in the chamber 101. It should be apparent however that fuel must flow between the control edges 97 and 98 in order to keep the engine operating, and to maintain this flow area, the adjusting screw 124 is axially adjusted to the position where, when no air pressure boost is provided by the turbocharger, the valve member 89 will be pushed downwardly sufficiently to maintain a flow area between the control edges 98 and 99. This initial position may be referred to as the "no-air" or "no-air boost" setting of the aneroid. During low engine speeds, the nut 126 is displaced upwardly and engages the under surface of the upper end cap member 107 and the adjusting spring 121 applies a downwardly directed force on the valve member 89.

The curve 69 in FIG. 4 also illustrates the fact that the fuel rail pressure must rise to a certain level before an air pressure boost is provided.

After the engine speed has risen to above the level 68, a positive air boost exists in the intake manifold and in the upper part of the chamber 109, and this pressure moves the diaphragm 111 and the cup member 132 downwardly. The amount of the force on the diaphragm is a function of the area of the upper surface of the diaphragm 111 and of the pressure in the upper part of the chamber 109 relative to the atmospheric pressure in the lower part of the chamber. This downwardly directed force exerted by the air pressure is counteracted by both the force of the auxiliary spring 136 and by the pressure of the fuel in the chamber 101. The size of the area of the lower end of the member 89, the area of the upper surface of the diaphragm 111, and the tension of the adjusting spring 121 are designed to produce the desired pressure in the fuel supply rail downstream of the aneroid 86. At engine speeds above the level 68, the diaphragm 111 moves downwardly and the operation of the aneroid during acceleration will be generally similar to that of the aneroid 31, except that the auxiliary spring 136 also exerts an upwardly directed force on the diaphragm 111. The tension of the auxiliary spring 136 determines the slope of the air boost versus rail pressure curve 69 and the auxiliary spring 136 also provides added stability in the performance of the aneroid in that it makes the aneroid less sensitive to mementary fluctuations in the air boost pressure in the intake manifold and in the fuel pressure.

The aneroid 146 illustrated in FIG. 6 produces a rail pressure versus air boost curve as illustrated by the curve 70 in FIG. 4. The aneroid 146 includes a valve body 147 having a bore 148 formed therein, a valve member 149 in the bore 148, an upper chamber forming part 151, an adjusting spring 152, an auxiliary spring 153, a diaphragm 154, a vent coupling 155, and a no-air boost adjusting screw 156, the foregoing parts all being similar to the corresponding parts of the aneroid 86 shown in FIG. 5. The valve body 147 further includes a fuel intake passage 157 and an outlet passage 158, and control edges 159 and 161 formed on the valve member 149 and on the upper surface of the inlet passage 157 form a flow area therebetween.

An elongated lower end cap member 162 is fastened to the lower end of the valve body 147 by screws 160 and forms a chamber 163. A movable piston 164 is located in the chamber 163 and a coiled compression spring 166 is mounted between the lower end of the valve member 149 and the piston 164. Projections 167 are formed on the lower end of the valve member 149 and on the upper end of the piston 164 in order to maintain the spring 166 centered. The lower end of the piston 164 is subjected to the pressure of the fuel in the outlet passage 158. This is accomplished by forming a loop passage 168 in the valve body 147 and another loop passage 169 in the lower cap member 162. The two passages 168 and 169 are connected by a tubular member 171 which extends into the two passages 168 and 169 and also ensures that the two passages will be properly aligned when the valve body 147 and the cap member 162 are assembled. The passage 169 extends downwardly to the lower end of the chamber 163 and includes a transverse portion 172 which extends to the chamber 163. The piston 164 has a hollow interior indicated by the reference numeral 173, and a passage 174 in the piston 164 connects the interior 173 with the passage 172. Consequently, fuel in the outlet passage 158 will fill the interior 173 of the piston 164 and the upward force exerted by the fuel on the piston 164 will be a function of the pressure of the fuel and of the area of the lower side of the piston 164. This upwardly directed force on the piston 164 will tend to move the spring 166 and the valve member 149 upwardly in opposition to the force exerted by the manifold air boost pressure. The two opposed forces will adjust the position of the valve member 149 and the flow area between the edges 159 and 161 in order to regulate the pressure downstream of the aneroid, as previously explained.

The portion of the chamber 163 which is above the piston 164 is vented to atmosphere by a passage 180 in the valve body 147, which connects the chamber 163 and the chamber below the diaphragm 154. The latter chamber is of course vented to atmosphere by the coupling 155.

With reference to FIG. 4, the reference numeral 70 indicates the curve representing the rail pressure versus air boost pressure for the aneroid 146. For the lower portion of the curve indicated by the reference numeral 176, the piston 164 is moved upwardly in response to the fuel pressure. At the point indicated by the numeral 177 in FIG. 4, the upper surface of the piston 164 engages an auxiliary spring 178 which is positioned in the chamber 163 between the lower surface of the valve body 147 and a spring retainer 179. The retainer 179 is movably suspended from the lower end of the valve body 147. The effect of the engagement of the piston 164 with the spring retainer 179 is to require an increased amount of change in the fuel pressure to change the position of the valve member 149, as a function of the air boost pressure change. Consequently, the slope of the upper portion 181 of the curve 70, above the point 177 has a substantially greater slope than the lower portion 176 of the curve, and this difference is due to the spring 178. The advantage of the aneroid shown in FIG. 6 is that it may be designed to have one operating characteristic at low rail pressures and another characteristic at higher rail pressures, and that the characteristics may be tailored by the selection of the spring characteristics.

FIG. 7 illustrates still another aneroid 190 having the characteristic illustrated by the curve 71 in FIG. 4. The aneroid 190 comprises a body 191 having a bore 192 formed therein, and a valve member 193 movably mounted in the bore 192. Once again, the valve member 193 has a recessed portion 194, and the lower edge where the recess 194 joins the lower portion of the valve member is referred to as a control edge 196. The body 191 has a fuel inlet passage 197, connected to a fuel supply line 198 and to a throttle 199. The body 191 further has a fuel outlet passage 201 and the port where the passage 201 connects with the bore 192 forms another control edge 202. A return loop passage 203 is formed in the valve body 191 and connects with the outlet passage 201, and the lower end of the bore 192 forms a chamber 204. Fuel from the outlet passage 201 enters the chamber 204, and the force exerted by the pressure of the fuel in the chamber 204 on the valve member 193 tends to move the member 193 upwardly.

The aneroid further includes a chamber housing 206 having an upper part 207 and a lower part 208. The chamber formed by the two parts 207 and 208 is separated by a flexible diaphragm 209 which extends across the chamber and is sealingly connected to the parts 207 and 208. The lower part 208 is secured to the upper end of the valve body 191, and a vent passage 211 is formed in the part 208. An air intake nipple 212 is formed in the upper part 207 so that the chamber formed by the upper part may be connected with the air intake manifold of the engine.

An adjusting screw 213 is threaded into a nut 214 which is fastened to the upper side of the upper part 207, the screw 213 having an elongated shank 215 and the lower end of the shank engaging the upper end of the valve member 193 in the no-air boost condition. The lower end of the shank 215 of the screw 213 thus forms a stop for the upper end of the valve member 193, and the position of the lower end of the shank 215 may be adjusted by turning the screw 213 in the nut 214.

An annular sleeve 216 is positioned around the shank 215 of the adjusting screw 213, the sleeve 216 being U-shaped in cross section as shown in FIG. 7. The inner periphery of the diaphragm 209 extends between the arms of the U of the sleeve 216 and is sealingly connected thereto. The opening 217 of the sleeve 216 makes a sealed, sliding connection with the shank 215 of the screw 213. Two coiled compression springs 218 and 219 are connected with the sleeve 216. The compression spring 218 extends between the sleeve 216 and a spring retainer 221 that is fastened to the upper end of the valve member 193. The other spring 219 is positioned between the upper side of the sleeve 216 and a spring retainer 222 which is fastened to the underside of the nut 214. It will be apparent therefore that the spring 219 urges the sleeve 216 and the center part of the diaphragm 209 downwardly relative to the nut 214, and that the spring 218 urges the retainer 221 and the valve member 193 downwardly relative to the diaphragm 209.

At relatively low engine speeds below the point 68, no air boost is produced and there is fuel pressure in the passage 201 which will appear in the chamber 204 and urge the valve member 193 upwardly. The valve member 193 moves upwardly to the location illustrated in FIG. 7 where its upper end engages the lower end of the shank 215 of the adjusting screw 213. This is referred to as the no-air boost pressure setting of the valve member 193, and at this point the minimum flow area is formed between the control edges 196 and 202. As the engine speed increases above the level 68, an increasing positive air boost pressure appears above the diaphragm 209 and urges the diaphragm downwardly. The forces of the air pressure and the spring 219 move the spring 218 and the valve member 193 downwardly slightly, thereby increasing the flow area between the control edges 196 and 202. As the diaphragm 209 and the sleeve 216 move downwardly, it relaxes the tension in the upper spring 219 and therefore the force exerted by the spring 219 gradually decreases. This produces the curved characteristic of the curve 71 in FIG. 4. The point 226 where the curve 71 bends is the point where the tension in the spring 219 is substantially relaxed and no longer exerts a downward force on the sleeve 216. Of course, the slopes of the portions of the curve 71 above and below the point 226 may be adjusted by proper selection of the tensions in the two springs 218 and 219.

It will be apparent from the foregoing that an advantageous aneroid has been provided. It maintains a desired fuel-to-air mixture at different engine speeds and during periods of acceleration. The aneroid functions in a constant, predictable manner because its characteristics are determined primarily by the relative areas of the daphragm and the end of the valve member which is exposed to the fuel pressure, and these areas are constant in a given design. The aneroid is less sensitive to fuel properties and to temperatures, and it is stable since there are minimum oscillations of the plunger with transient air and fuel pressure changes. Further advantages are that the aneroid operation is independent of the fuel flow in the rail, and a separate start valve is not necessary.

The slope of the rail pressure to air boost curve determined by the diaphragm and valve member areas as previously mentioned, but the slope may be tailored by the use of an auxiliary spring as shown in FIGS. 5 and 6. A piston as shown in FIG. 6 and be used to change the slope of the curve at a given fuel pressure. By using a spring on each side of the diaphragm as shown in FIG. 7 it is possible to obtain an immediate rail pressure increase over the no air boost setting.

While the air pressure and the fuel pressure have been shown as acting on opposite ends of the valve member, they could be arranged to act on the same end in opposition to each other.

I claim:

1. An aneroid for use in a fuel supply system for an internal combustion engine including a turbocharger, wherein the quantity of fuel injected in each cycle of the engine is controlled by adjusting the pressure of the fuel in a fuel supply rail, comprising valve means adapted to be connected in said rail and operable to adjust the rail pressure, first means adapted to respond to the pressure boost of the turbocharger and operatively coupled to said valve means for adjusting the rail pressure, and second means adapted to respond to the rail pressure downstream of the aneroid and connected to said valve means for adjusting the rail pressure, said first means being operable to increase the rail pressure with an increase in turbocharger boost and said second means being operable to reduce the rail pressure with an increase in the rail pressure downstream of the aneroid.

2. An aneroid as in claim 1, wherein said first means comprises a diaphragm, one side of said diaphragm being responsive to said pressure boost and the other side being coupled to said valve means.

3. An aneroid for use in a fuel supply system for an internal combustion engine including a turbocharger, wherein the quantity of fuel injected in each cycle of the engine is controlled by adjusting the pressure of the fuel in a fuel supply rail, comprising valve means adapted to be connected in said rail and operable to adjust the rail pressure, first means adapted to respond to the pressure boost of the turbocharger and operatively coupled to said valve means for adjusting the rail pressure, and second means adapted to respond to the rail pressure downstream of the aneroid and connected to said valve means for adjusting the rail pressure, said first means being operable to increase the rail pressure with an increase in turbocharger boost and said second means being operable to reduce the rail pressure with an increase in the rail pressure downstream of the aneroid, said first means comprising a diaphragm having a side connected to said valve means by an adjusting spring.

4. An aneroid as in claim 3, and further including an auxiliary spring connected between said diaphragm and a stop and urging said diaphragm in the direction to reduce the rail pressure.

5. An aneroid for use in a fuel supply system for an internal combustion engine including a turbocharger, wherein the quantity of fuel injected in each cycle of the engine is controlled by adjusting the pressure of the fuel in a fuel supply rail, comprising valve means adapted to be connected in said rail and operable to adjust the rail pressure, first means adapted to respond to the pressure boost of the turbocharger and operatively coupled to said valve means for adjusting the rail pressure, and second means adapted to respond to the rail pressure downstream of the aneroid and connected to said valve means for adjusting the rail pressure, said first means being operable to increase the rail pressure with an increase in turbocharger boost and said second means being operable to reduce the rail pressure with an increase in the rail pressure downstream of the aneroid, and further including adjustable means engagable with said valve means for limiting the reduction in rail pressure when the turbocharger does not produce a pressure boost.

6. An aneroid as in claim 1, wherein said second means comprises a chamber located in communication with said valve means and with the rail pressure downstream of said aneroid, the rail pressure in said chamber urging said valve means in the direction to reduce the rail pressure.

7. An aneroid as in claim 6, and further including a movable piston in said chamber, spring means connecting said valve means and said piston, and said rail pressure being in pressure communication with the side of said piston which is opposite from said spring means.

8. An aneroid for use in a fuel supply system for an internal combustion engine including a turbocharger, wherein the quantity of fuel injected in each cycle of the engine is controlled by adjusting the pressure of the fuel in a fuel supply rail, comprising valve means adapted to be connected in said rail and operable to adjust the rail pressure, first means adapted to respond to the pressure boost of the turbocharger and operatively coupled to said valve means for adjusting the rail pressure, and second means adapted to respond to the rail pressure downstream of the aneroid and connected to said valve means for adjusting the rail pressure, said first means being operable to increase the rail pressure with an increase in turbocharger boost and said second means being operable to reduce the rail pressure with an increase in the rail pressure downstream of the aneroid, said second means comprising a chamber located in communication with said valve means and with the rail pressure downstream of said aneroid, the rail pressure in said chamber urging said valve means in the direction to reduce the rail pressure, a movable piston in said chamber, spring means connecting said valve means and said piston, said rail pressure being in pressure communication with the side of said piston which is opposite from said spring means, and further including an auxiliary spring means engagable with said piston only after a predetermined amount of movement of said piston in the direction of said valve means.

9. An aneroid for a fuel system of an engine including a turbocharger, a plurality of injectors, a rail for carrying fuel to the injectors, and means for supplying and regulating the pressure of the fuel in the rail, said aneroid comprising valve means connected in the rail and operable to adjust the fuel pressure in the rail, said valve means including a movable member which is movable to adjust the fuel flow area through the rail and thereby adjust the fuel pressure downstream of the aneroid, said aneroid further including manifold air pressure responsive means operatively coupled to said member and operable to move said member in the direction to increase the fuel flow area in response to an increase in the manifold pressure, and rail pressure responsive means operatively coupled to said member and operable to decrease the fuel flow area in response to an increase in the fuel pressure in the rail downstream of the aneroid.

10. An aneroid as in claim 9, wherein said aneroid further includes a housing having a bore formed therein, said member being movable in said bore, said housing further having a fuel inlet passage and a fuel outlet passage formed therein, said passages being connected to said bore and adapted to be connected to the rail, and said member adjusting the fuel flow area from said inlet passage, through said bore, and to said outlet passage.

11. An aneroid as in claim 10, wherein said rail pressure responsive means comprises a chamber formed in said housing and adapted to be connected to the rail pressure downstream of said aneroid, said member having one end thereof in pressure communication with said chamber.

12. An aneroid for a turbocharged engine including a plurality of injectors, a rail for supplying fuel to the injectors, and pressure regulator means for regulating the fuel pressure in the rail, said aneroid comprising a housing having a bore formed therein, an inlet passage connected to said bore and adapted to be connected to said rail upstream of said aneroid, an outlet passage connected to said bore and adapted to be connected to said rail downstream of said aneroid, a valve member movable in said bore and operable to form a variable area fuel flow passage between said inlet and outlet passages, first means responsive to the turbocharger boost and operable to move said member to increase said area in response to an increase in boost, and second means responsive to the rail fuel pressure downstream of said aneroid and operable to move said member to decrease said area in response to an increase in rail fuel pressure.

13. An aneroid as in claim 12, wherein said second means comprises a chamber formed in said housing and adapted to receive fuel from the rail downstream of the aneroid.

14. An aneroid as in claim 13, and further including a piston movable in said chamber, and a spring connecting said piston and said member.

15. An aneroid for a turbocharged engine including a plurality of injectors, a rail for supplying fuel to the injectors, and pressure regulator means for regulating the fuel pressure in the rail, said aneroid comprising a housing having a bore formed therein, an inlet passage connected to said bore and adapted to be connected to said rail upstream of said aneroid, an outlet passage connected to said bore and adapted to be connected to said rail downstream of said aneroid, a valve member movable in said bore and operable to form a variable area fuel flow passage between said inlet and outlet passages, first means responsive to the turbocharger boost and operable to move said member to increase said area in response to an increase in boost, and second means responsive to the rail fuel pressure downstream of said aneroid and operable to move said member to decrease said area in response to an increase in rail fuel pressure, said second means comprising a chamber formed in said housing and adapted to receive fuel from the rail downstream of the aneroid, a piston movable in said chamber, and a spring connecting said piston and said member, and further including a second spring which is engagable with said piston only after said piston has moved a predetermined distance.

16. An aneroid for a turbocharged engine including a plurality of injectors, a rail for supplying fuel to the injectors, and pressure regulator means for regulating the fuel pressure in the rail, said aneroid comprising a housing having a bore formed therein, an inlet passage connected to said bore and adapted to be connected to said rail upstream of said aneroid, an outlet passage connected to said bore and adapted to be connected to said rail downstream of said aneroid, a valve member movable in said bore and operable to form a variable area fuel flow passage between said inlet and outlet passages, first means responsive to the turbocharger boost and operable to move said member to increase said area in response to an increase in boost, and second means responsive to the rail fuel pressure downstream of said aneroid and operable to move said member to decrease said area in response to an increase in rail fuel pressure, said first means comprising a diaphragm having one side thereof responsive to the turbocharger boost, and a spring connecting the other side of said diaphragm with said member.

17. An aneroid as in claim 16, and further including means for adjusting the tension in said spring.

18. An aneroid as in claim 16, and further including a second spring connected between said one side of said diaphragm and said housing.

19. An aneroid as in claim 16, and further including an auxiliary spring connecting said other side of said diaphragm with said housing.

20. An aneroid for a turbocharged engine including a plurality of injectors, a rail for supplying fuel to the injectors, and pressure regulator means for regulating the fuel pressure in the rail, said aneroid comprising a housing having a bore formed therein, an inlet passage connected to said bore and adapted to be connected to said rail upstream of said aneroid, an outlet passage connected to said bore and adapted to be connected to said rail downstream of said aneroid, a valve member movable in said bore and operable to form a variable area fuel flow passage between said inlet and outlet passages, first means responsive to the turbocharger boost and operable to move said member to increase said area in response to an increase in boost, and second means responsive to the rail fuel pressure downstream of said aneroid and operable to move said member to decrease said area in response to an increase in rail fuel pressure, and further including adjustable means for setting the position of said valve member in the absence of a turbocharger boost.

* * * * *